United States Patent [19]

Padfield et al.

[11] Patent Number: 4,706,302

[45] Date of Patent: Nov. 17, 1987

[54] COMFORT PAD

[76] Inventors: Barbara J. Padfield, 750 Somerville St., Manchester, N.H. 03103; George Spector, 233 Broadway, Rm 3815, New York, N.Y. 10007

[21] Appl. No.: 904,111

[22] Filed: Sep. 4, 1986

[51] Int. Cl.[4] ..... A41D 13/06

[52] U.S. Cl. ..... 2/22; 2/24; 2/413; 128/149

[58] Field of Search ..... 2/22, 23, 24, 20, 16, 2/267; 128/149

[56] References Cited

U.S. PATENT DOCUMENTS

| | | | |
|---|---|---|---|
| 2,603,786 | 7/1952 | Haines | 2/24 |
| 2,626,394 | 1/1953 | Davis | 2/24 |
| 3,039,109 | 6/1962 | Simpson | 2/413 |
| 3,593,340 | 7/1971 | Powell | 2/24 |
| 3,659,846 | 5/1972 | Kanicki | 2/24 X |
| 3,937,218 | 2/1976 | Gaylord, Jr. | 2/24 X |
| 4,038,700 | 8/1977 | Györy | 2/413 |
| 4,354,284 | 10/1982 | Grooding | 2/413 |

*Primary Examiner*—Louis K. Rimrodt
*Assistant Examiner*—J. L. Olds

[57] ABSTRACT

A comfort pad is provided and consists of a Y-shaped strap that is wrapped around a leg of a person and secured to a pillow that acts as a cushion to relieve pressure on knee bones as well as stress on hips, when a person sleeps on their side.

5 Claims, 3 Drawing Figures

COMFORT PAD

BACKGROUND OF THE INVENTION

The instant invention relates generally to pads and more specifically it relates to a comfort pad.

Numerous pads have been provided in prior art that are adapted to protect knees and the like.

For example, U.S. Pat. Nos. 2,476,565; 2,626,394 and 4,250,578 all are illustrative of such prior art. While these units may be suitable for the particular purpose to which they address, they would not be as suitable for the purposes of the present invention as heretofore described.

SUMMARY OF THE INVENTION

A primary object of the present invention is to provide a comfort pad, that will overcome the shortcomings of the prior art devices.

Another object is to provide a comfort pad that will relieve pressure on knee bones as well as stress on hips, when a person sleeps on their side.

An additional object is to provide comfort pad that has a strap that is wrapped around a limb of a person and secured to a pillow.

A further object is to provide a comfort pad that is simple and easy to use.

A still further object is to provide a comfort pad that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
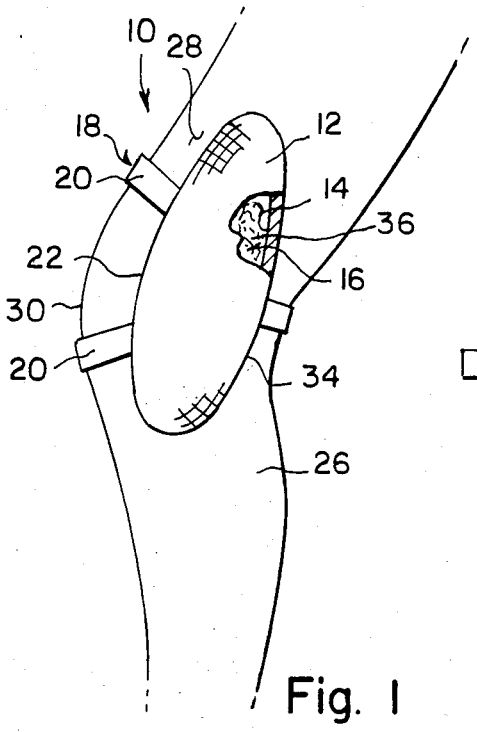
FIG. 1 is a side view of the invention attached to the leg.
Figure 2:
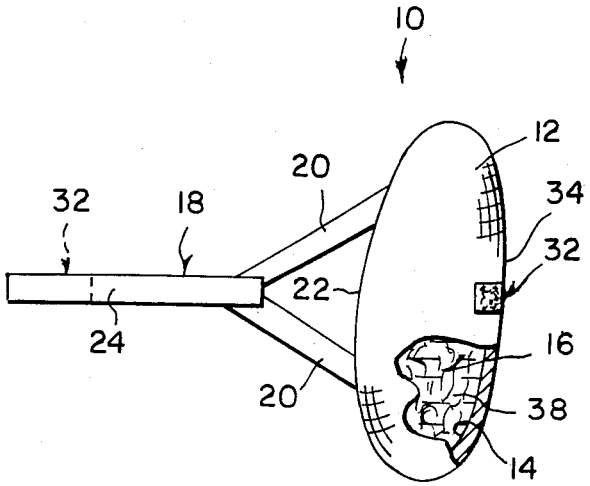
FIG. 2 is a side view with parts broken away of the invention removed from the leg.

Turning now descriptively to the drawings, in which similar reference characters denote similar elements throughout the several views, FIGS. 1 and 2 illustrate a comfort pad 10 consisting of a pillow 12 that has a hollow chamber 14 within. Cushioning material 16 is placed within the hollow chamber 14 of the pillow 12. A Y-shaped strap 18 has two arms 20 extending from side 22 of the pillow 12 and an attachable terminal end 24 to wrap around a leg 26 of a person at side 28 of an knee 30 thereof.

A loop-hook fabric fastener 32 secures the terminal end 24 to opposite side 34 of the pillow 12. The pillow 12 will stay in place between knees of the person to relieve pressure on knee bones as well as stress on hips when the person is sleeping on their side.

As indicated in FIG. 1 the cushioning material 16 can be contoured padding 36. As indicated in FIG. 2, the pillow 12 can be fabricated out of a liquid retaining material while the cushioning material is a liquid gel 38. Both the contoured padding 36 and liquid gel 38 will fill a surrounding depressed area to absorb and dispurse weight uniformly across the area.

Figure 3:
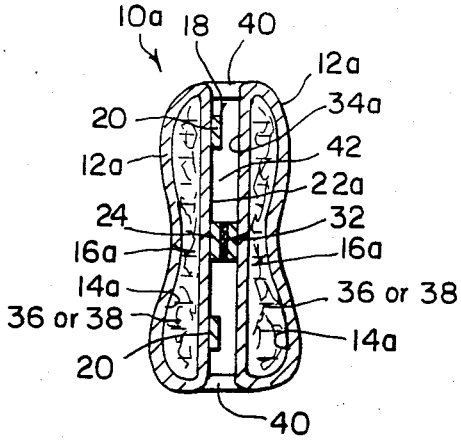
FIG. 3 is a cross sectional view showing a modification being two pillows with space therebetween for attaching the Y-shaped strap within the space.

FIG. 3 shows a modified comfort pad **10*a* that contains a pair of pillows 12*a* each having a hollow chamber 14*a* within. The pillows 12*a* are secured together by bands 40 and have a space 42 therebetween. Cushioning material 16 being either contoured padding 36 or liquid gel 38 is placed within the hollow chambers 14*a* of the pillows 12*a*. A Y-shaped strap 18 has two arms 20 extending from side 22*a* of one of the pillows 12*a* and an attachable terminal end 24 to wrap around leg 26 of a person at side 28 of knee 30 in the same manner as in comfort pad 10**.

A loop-hook fabric fastener 32 secures the terminal end 24 to opposite side **34*a* of the other pillow 12*a* within the space 42 and operates in the same manner as in comfort pad 10. Since the attachment of the Y-shaped strap 18 is inbetween the pair of pillows 12*a* at space 42 greater comfort is created for the person wearing the comfort pad 10*a***.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A comfort pad comprising:

(a) a pillow with opposite sides having a hollow chamber within;

(b) cushioning material placed within said hollow chamber of said pillow;

(c) a Y-shaped strap having two arms extending from one of said sides of said pillow and an attachable single terminal strap extending from said arms to the opposite of said sides to wrap around a leg of a person at side of a knee thereof and be secured thereat;

(d) means for securing said terminal end directly to said opposite side of said pillow so that said pillow will stay in place between knees of said person to relieve pressure on knee bones as well as stress on hips.

2. A comfort pad as recited in claim 1, wherein said securing means is a loop-hook fabric fastener.

3. A comfort pad as recited in claim 1, further comprising:

(a) said pillow fabricated out of a liquid retaining material; and (b) said cushioning material being liquid gel to fill in surrounding depressed area to absorb and disperse weight uniformly across said area.

4. A comfort pad comprising:

(a) a pair of pillows with opposite sides each having a hollow chamber within, said pillows secured together having a space therebetween;

(b) cushioning material placed within said hollow chambers of said pillows:

(c) a Y-shaped strap having two arms extending from one side of said pillows and an attachable terminal strap mounted on one of said pillows to wrap around a leg of a person at side of a knee thereof; and (d) means for securing said terminal end to said pillows within said space so that said pillow will stay in place between knees of said person to relieve pressure on knee bones.

5. A comfort pad as recited in claim 4, wherein said securing means is a fastener which secures said terminal strap to the other of said pillows within said space.

* * * * *